US005215279A

United States Patent [19]

Foit

[11] Patent Number: 5,215,279

[45] Date of Patent: Jun. 1, 1993

[54] CABLE REEL WITH OFF-SET SPOKES

[75] Inventor: Vilem Foit, Vancouver, Canada

[73] Assignee: Hillmar Industries Ltd., Delta, Canada

[21] Appl. No.: 811,232

[22] Filed: Dec. 20, 1991

[51] Int. Cl.[5] ..... B65H 75/18

[52] U.S. Cl. ..... 242/117

[58] Field of Search ..... 242/54 R, 117, 118, 242/118.4, 118.6, 77, 77.1, 77.3, 77.4, 86.61, 158.1, 158.5, 118.41

[56] References Cited

U.S. PATENT DOCUMENTS

| | | | |
|---|---|---|---|
| 2,649,261 | 8/1953 | Bodik et al. | 242/117 |
| 3,135,478 | 6/1964 | Harlander | 242/117 |
| 3,534,920 | 10/1970 | McGrath et al. | 242/117 |
| 3,576,295 | 4/1971 | Hale | 242/54 R |
| 3,731,886 | 5/1973 | Macchi | 242/77.1 |
| 3,837,590 | 9/1974 | Pollock | 242/117 X |
| 3,946,618 | 3/1976 | Green | 242/117 |
| 3,960,340 | 6/1976 | Naas | 242/117 |

*Primary Examiner*—Daniel P. Stodola
*Assistant Examiner*—John P. Darling
*Attorney, Agent, or Firm*—Brian M. Long

[57] ABSTRACT

A cable reel has first and second sets of spokes extending radially from a hub, the spokes of the first set being spaced axially of the hub from the spokes of the second set so as to snugly accommodate a monospirally-wound cable between the first and second sets. The spokes of the first set are angularly off-set from the spokes of the second set, as viewed axially of the hub, so as to accommodate a splice in the cable between the first and second sets.

4 Claims, 3 Drawing Sheets

CABLE REEL WITH OFF-SET SPOKES

BACKGROUND OF THE INVENTION

1. Field of the invention.

The present invention relates to a cable reel which is useful in particular for storing a monospirally-wound power cable.

2. Description of Related Art.

Large diameter power cables typically have a diameter of 2½ inches and a length exceeding 2,000 ft.

Conventional cable reels for storing such a power cable are formed of a hub having first and second sets of spokes extending radially from the hub, with the first set spaced in the axial direction of the hub from the second set so as to accommodate the power cable between the first and second sets.

As viewed axially of the hub, the spokes of the first set coincide with those of the second set. Consequently, in order to accommodate between the spokes of the first and second sets any splice which may be present in the cable, the spacing of the first set from the second set, axially of the hub, is made larger than the diameter of the cable and also slightly larger than the anticipated diameter of the cable splice.

This, however, has the disadvantage that when the cable is wound on the reel, the successive turns of the cable can become off-set from one another, in the axial direction of the hub, with the result that the cable exerts lateral loads on the spokes of the reel. It is therefore necessary, in order to counteract such lateral loading of the spokes, to provide the spokes with a heavier, stronger structure than would otherwise be required.

SUMMARY OF THE INVENTION

According to the present invention, there is provided a cable reel, comprising a hub, first and second sets of spokes extending radially from the hub, the spokes of the first set being spaced axially of the hub from the spokes of the second set so as to snugly accommodate a monospirally-wound cable between the first and second sets; and the spokes of the first set being angularly off-set from the spokes of the second set, as viewed axially of the hub, so as to accommodate a splice in the cable between the first and second sets.

With this reel, the successive turns of the cable wound on the reel are retained, by their snug fit between the first and second sets of spokes, from becoming laterally off-set from one another, which avoids the lateral loading of the spokes referred to above. However, the off-setting of the spokes of the two sets allow a splice in the cable to protrude into a spacing between successive spokes at one side of the cable, thus accommodating the diameter of the splice, which is greater than that of the remainder of the cable.

BRIEF DESCRIPTION OF THE DRAWINGS

Further objects, features and advantages of the present invention will become more readily apparent to those skilled in the art from the following description of the invention when taken in conjunction with the accompanying drawings, in which.

DESCRIPTION OF THE PREFERRED EMBODIMENT

Figure 1:
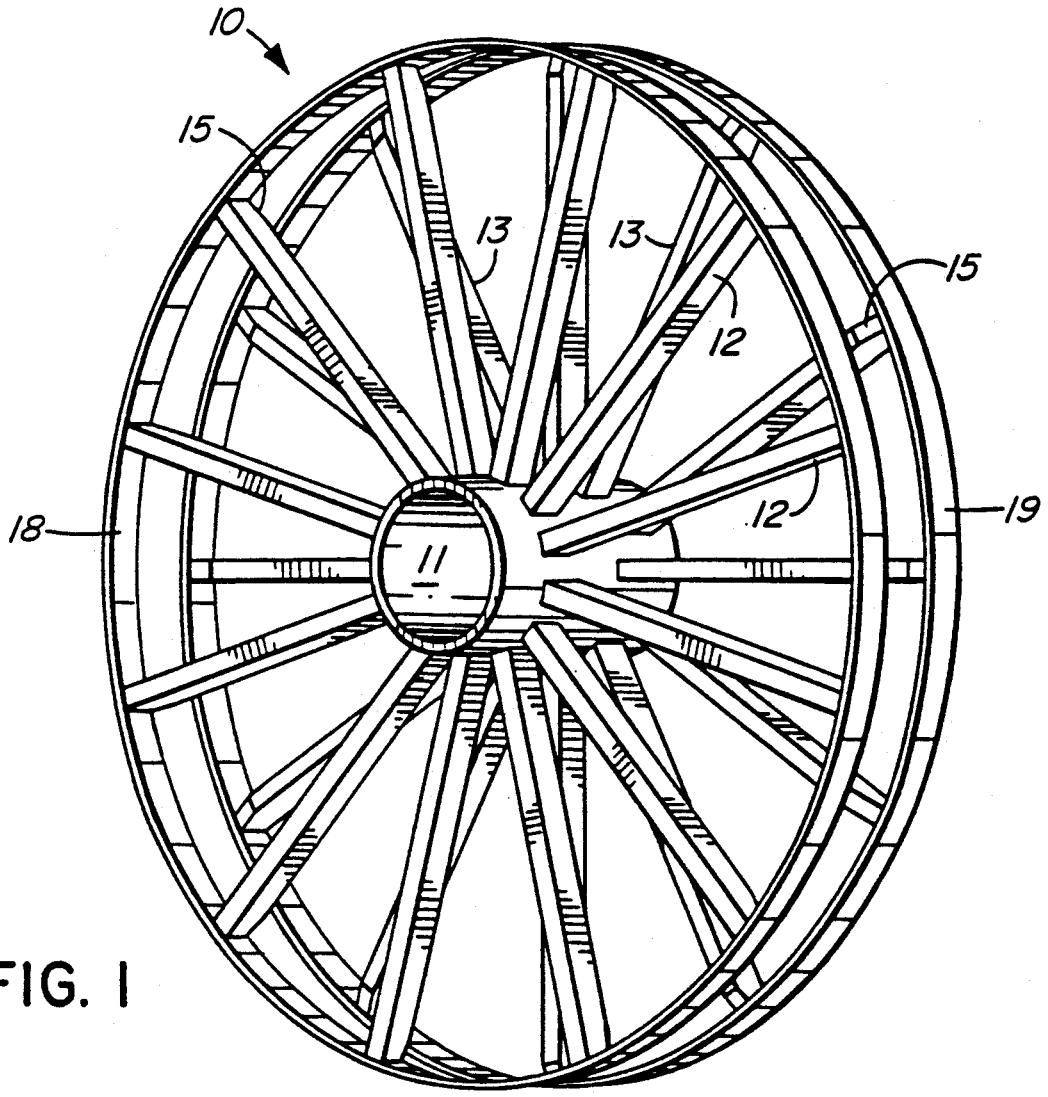
FIG. 1 shows a view in perspective of a cable reel according to a first embodiment of the invention.

As shown in FIG. 1 of the accompanying drawings, a cable reel according to the first embodiment of the present invention is indicated generally by reference numeral 10 and has a hub 11, a first set of spokes 12 and a second set of spokes 13.

The first set of spokes 12 are spaced axially of the hub 10 from the second set of spokes 13 by a spacing S1 (FIG. 1*a*), the magnitude of which is slightly greater than the diameter of a cable 16 (FIG. 4) which is to be wound on the cable reel 10.

Figure 1A:
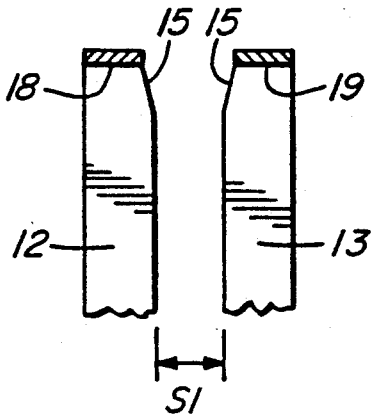
FIG. 1*a* shows a broken-away view, in axial cross-section, through parts of the cable reel of FIG. 1.

The outer ends of the spokes 12 and 13 are connected by rims 18 and 19, respectively, and as can be seen from FIG. 1*a* have opposed radially inwardly inclined end portions 15, which facilitate reception of the cable 16 between the two sets of spokes.

Figure 2:
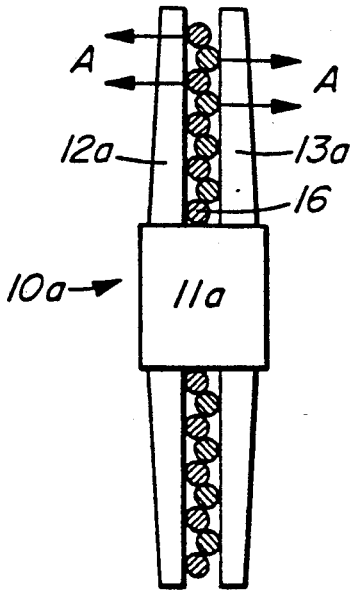
FIG. 2 PRIOR ART
FIG. 2 shows a diagrammatic view in axial cross-section through a prior art cable reel.

The advantage of the present spoke arrangement will be more readily apparent from consideration of the prior art cable reel indicated generally by reference numeral **10*a*** in FIG. 2.

Figure 3:
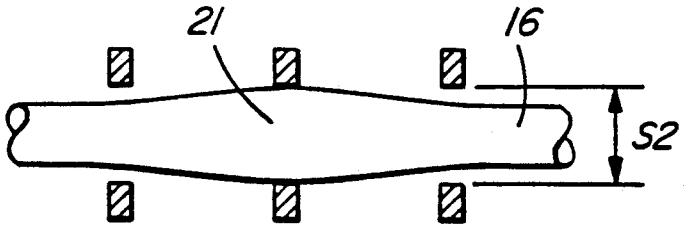
FIG. 3 PRIOR ART
FIG. 3 shows a view in horizontal cross-section through parts of the cable reel of FIG. 3.

The cable reel **10*a* has a hub 11*a* and two sets of spokes 12*a* and 13*a* which are spaced apart from one another, axially of the hub 11*a***, by a spacing S2 (FIG. 3).

As illustrated in FIG. 3, the spacing S2 is selected so as to be sufficiently greater than the diameter of the cable 16 as to accommodate, between the spokes **12*a* and the spokes 13*a*, the larger diameter of a splice 21 in the cable 16**.

However, since the spacing S2 is thus greater than the diameter of the cable 16, the successive turns of the cable 16 on the reel **16*a*** can become laterally off-set rom one another, as illustrated in FIG. 2.

Consequently, the cable 16 exerts on the spokes **12*a* and 13*a* of the cable reel 10*a* lateral loadings which are represented by arrows A in FIG. 2, and the spokes 12*a* and 13*a*** therefore have to be strengthened, by giving them a heavy structure, in order to withstand these lateral loadings.

In contrast to this, the spacing S1 between the spokes 12 and 13 of the cable reel 10 of FIGS. 1 and 1*a* is less than the spacing S2 and is only slightly greater than the diameter of the cable 16, so that the cable 16 is accommodated snugly between the spokes 12 and 13. Thus, the cable 16 is held by the spokes 12 and 13 from becoming laterally off-set in the manner described above with reference to FIG. 2, so that the spokes 12 and 13 are not subjected to the lateral loadings A described above with reference to FIG. 2. The spokes 12 and 13 can therefore be given a lighter and less expensive structure than was required for the spokes **12*a* and 13*a* of the prior art reel 10*a***.

This is possible because, while the spokes 12*a* and 13*a* of the prior art reel, as viewed axially of the reel, coincide with one another, i.e. are not angularly off-set from one another, the spokes 12 of the cable reel 10 are angularly off-set, about the axis of the hub 10, from the spokes 13.

More particularly, as viewed axially of the hub 10, the spokes 12 are located midway between the spokes 13.

Figure 4:
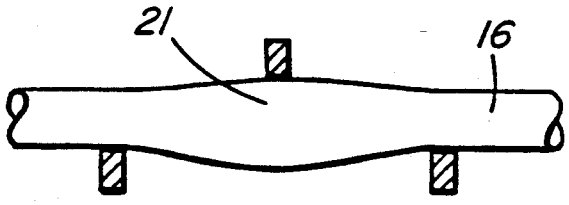
FIG. 4 shows a view corresponding to that of FIG. 3 but taken in section through parts of the cable reel of FIG. 1.

This angular off-setting of the spokes 12 and 13 enables the splice 21 to protrude between successive spokes 12, for example, as illustrated in FIG. 4. Thus, although the spacing S1 of the spokes 12 from the spokes 13 is less than the diameter of the splice 21, the splice 21 can be accommodated in the reel.

Figure 5:
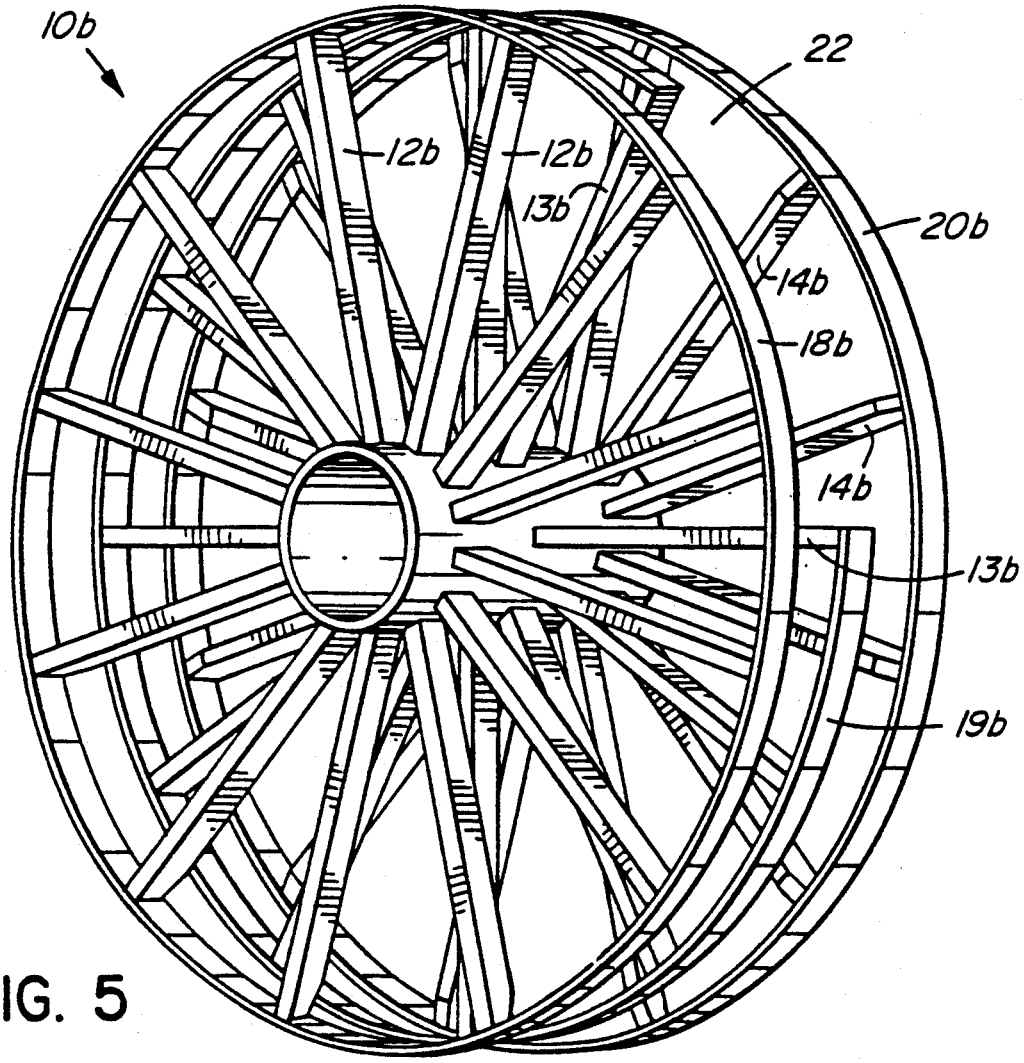
FIG. 5 shows a view in perspective of a cable reel according to a second embodiment of the present invention.
Figure 5A:
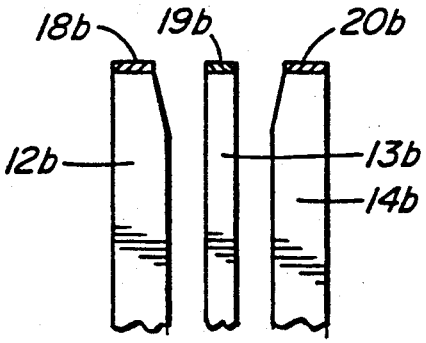
FIG. 5*a* shows a broken-away view taken in horizontal cross-section through parts of the cable reel of FIG. 5.

The second embodiment of the invention, illustrated in FIGS. 5 and 5*a* of the drawings, is intended to hold a power cable in two spaced monospirals. More particularly, the cable reel shown in FIGS. 5 and 5*a*, which is indicated generally by reference numeral 10*b*, has first and second spokes 12*b* and 13*b*, which are angularly offset from one another as described above with reference to the spokes 12 and 13 of FIG. 1 to accommodate a cable splice such as the splice 21. In addition, the cable reel 10*b* has a third set of spokes 14*b*, which are similarly angularly offset from the spokes 13*b* for the same purpose. As viewed axially of the hub, the spokes 12*b* and the spokes 14*b* are each midway between the spokes 13*b*.

The spokes 12*b* are spaced from the spokes 13*b* so as to receive the cable 16 snugly between them and likewise the spokes 14*b* are also spaced from the spokes 13*b* so as to receive the cable 16 snugly between them.

The second set of spokes 13*b* are interrupted by omission of one of the spokes to form a gap 22, through which the cable can be passed to and fro for forming, for example, successive pairs of turns of the cable between the first and second spoke set and the second and third spokes set, which enables the diameter of the reel 10*b* to be substantially smaller than would otherwise be required. In this way, a first pair of turns between the first and second spoke sets, followed by a second pair of turns between the second and third spoke set, and so forth, can be used to store the cable without the formation of excessively large build-up of cable at the cross-over point in the gap 22.

The three spoke sets are provided with respective rims 18*b*, 19*b* and 20*b*, of which the rim 19*b* is interrupted as shown at the gap 22.

As will be apparent to those skilled in the art, various modifications of the present invention may be made within the scope of the invention as defined in the appended claims.

I claim:

1. A cable reel, comprising:

a hub;

first and second sets of spokes extending radially from said hub;

said spokes of said first set being spaced axially of said hub from said spokes of said second set so as to snugly accommodate a monospirally-wound cable between said first and second sets; and said spokes of said first set being angularly off-set from said spokes of said second set, as viewed axially of said hub, so as to accommodate a splice in the cable between said first and second sets.

2. A cable reel as claimed in claim 1, wherein, in the circumferential direction of said hub, said spokes of said first set are located mid-way between said spokes of said second set.

3. A cable reel as claimed in claim 1, further comprising a third set of spokes extending radially of said hub, said third set being spaced axially of said hub from said second set so as to snugly accommodate a monospirally-wound further cable therebetween, said second set being located between said first and third sets, and said spokes of said third set being angularly off-set from said spokes of said second set so as to accommodate a splice in the further cable between said second and third sets.

4. A cable reel as claimed in claim 3, wherein, in the circumferential direction of said hub, said spokes of said second set are located mid-way between said spokes of said first and third sets.

* * * * *